United States Patent [19]

Chartet

[11] 4,041,594

[45] Aug. 16, 1977

[54] BRAZED CORE RADIATOR IN ALUMINUM ALLOY AND ADDED HEADER BOXES

[75] Inventor: André Chartet, Meudon, France

[73] Assignee: Societe Anonyme des Usines Chausson, Asnieres, France

[21] Appl. No.: 572,448

[22] Filed: Apr. 28, 1975

Related U.S. Application Data

[62] Division of Ser. No. 378,874, July 13, 1973, abandoned.

[30] Foreign Application Priority Data

Aug. 2, 1972 France ..... 72.27893

[51] Int. Cl.[2] ..... B23P 15/26

[52] U.S. Cl. ..... 29/157.3 C; 165/151

[58] Field of Search ..... 29/157.3 C; 165/151

[56] References Cited

U.S. PATENT DOCUMENTS

| | | | |
|---|---|---|---|
| 2,184,658 | 12/1939 | Young | 165/79 |
| 2,567,716 | 9/1951 | Kritzer | 29/157.3 C |
| 2,602,413 | 7/1952 | Miller | 29/157.3 C |
| 2,656,155 | 10/1953 | Garrat | 165/79 |
| 2,933,291 | 4/1960 | Huggins | 165/149 X |
| 3,628,603 | 12/1971 | Fieni | 165/151 |
| 3,750,747 | 8/1973 | Hingorany | 29/157.4 |

FOREIGN PATENT DOCUMENTS

| | | | |
|---|---|---|---|
| 2,115,434 | 10/1971 | Germany | 29/157.4 |
| 724,017 | 2/1955 | United Kingdom | 165/173 |
| 699,032 | 10/1953 | United Kingdom | 165/173 |
| 731,431 | 6/1955 | United Kingdom | 165/173 |

*Primary Examiner*—C.W. Lanham
*Assistant Examiner*—V. K. Rising
*Attorney, Agent, or Firm*—Browdy and Neimark

[57] ABSTRACT

The exchanger comprises tubes separated by intercalary parts and engaged into end plates covered with header boxes. The tightness of the header boxes is provided by a soft joint 13. A brazing alloy is sandwiched between two sheets of aluminum.

14 Claims, 8 Drawing Figures

BRAZED CORE RADIATOR IN ALUMINUM ALLOY AND ADDED HEADER BOXES

This is a division, of application Ser. No. 378,874, filed July 13, 1973, now abandoned.

It has already being proposed in the art to manufacture radiators — for cooling heat engines or for heating the inside of a vehicle — having header boxes made of synthetic material or of glass and which are tightly connected to the end-plates of the radiator core through tightening.

This tightness if accomplished by means of a distortable joint placed between each header box and each end plate.

It has been determined that the means used up to the present may have been satisfactory in case of conventional radiators made of heavy metals, i.e., cupreous and/or ferrous metals, however such means cannot be embodied in the radiators with the core — which means that the tube plates, the tubes and the dissipators are made of aluminum or of aluminum alloy.

In fact, in the radiators with a core made of aluminum its connection between the parts is accomplished by melting a brazing alloy which covers the parts and which is melted on all the portions of the core in forming a granulous surface, whereby a satisfactory tightness cannot be obtained by a simple resilient deformation of a soft joint placed between the end plates of such cores and the inserted header boxes.

The present invention creates a new radiator of which the core is entirely made of aluminum or aluminum alloy and of which the header boxes are made of other materials, typically or synthetic resin, glass or rubber.

According to the invention, the tubular core radiator having tubes, tube plates and corrugated fin plates made of aluminum or aluminum alloy and joined through brazing, and header boxes inserted and separated from the end plates by a deformable soft gasket, is characterized in that at least the end plates on the side thereof which is turned towards the header boxes is free of brazing plating, said end plates being shaped to delimit on the periphery thereof a hollow rim having a smooth inner surface, and on the bottom of which a peripheral edge of the header box tightens said soft gasket.

Various other characteristics of the invention are moreover shown in the following detailed description.

Embodiments of the invention are shown by way of non-restrictive examples in the accompanying drawings, in which.

Figures 1, 2, 3, 4, 5, 6, 7, 8:
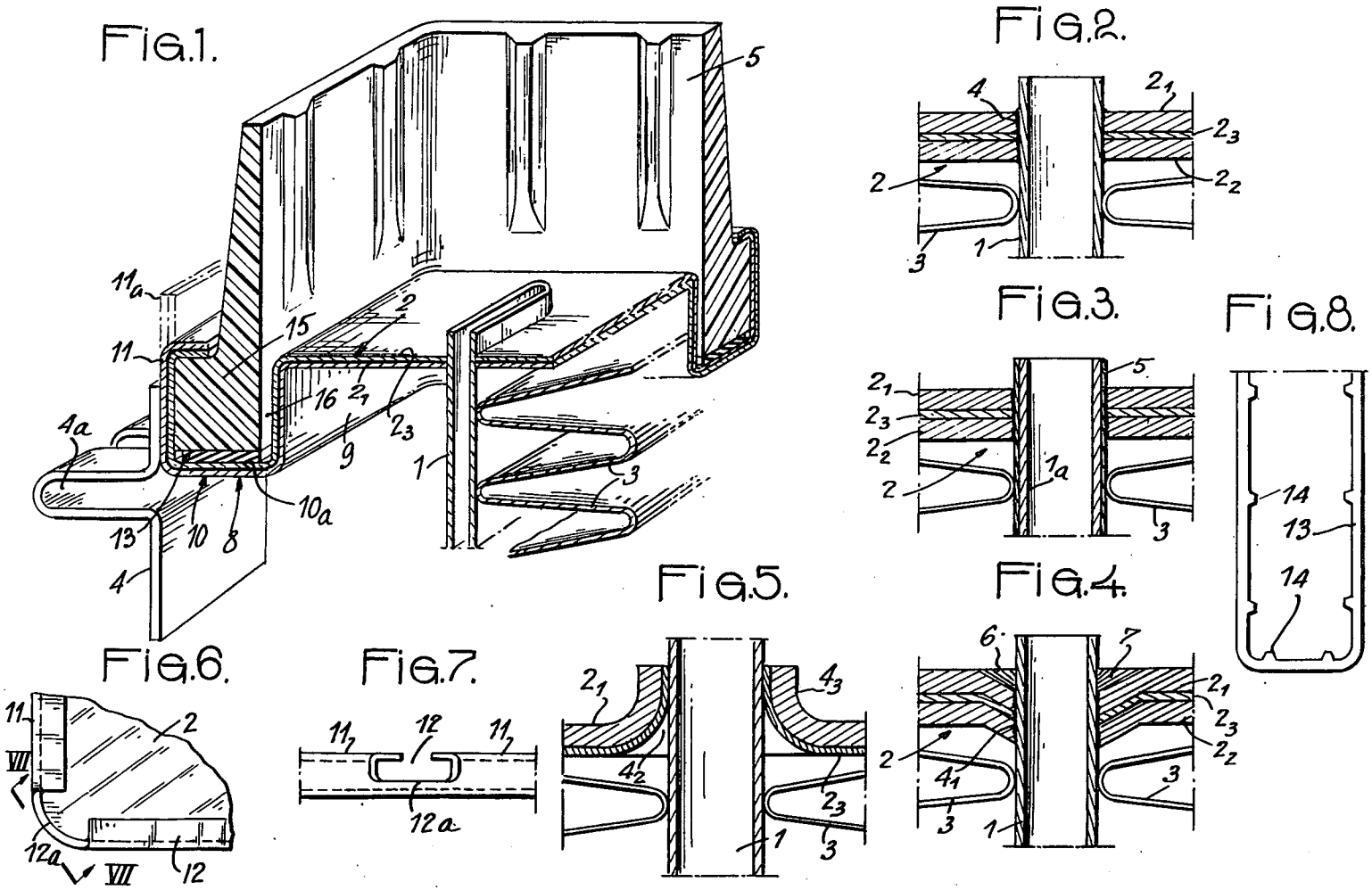
FIG. 1 is a partial and partly sectional perspective view of the radiator according to the invention.
FIGS. 2 to 5 are very enlarged sectional views showing different modifications of a portion of the radiator shown on FIG. 1.
FIG. 6 is a partial plan of a portion of one of the radiator parts.
FIG. 7 is a view taken along line VII—VII of FIG. 6.
FIG. 8 is a partial plan of a part shown on FIG. 1.

The radiator comprises tubes 1 for the circulation of a fluid to be cooled, tube plates 2 slipped on the two ends of the tubes 1, flow dissipators 3 placed between the successive tubes, and lateral plates 17 to envelop the finished radiator core. The tube plates 2 are each covered with a header box 5 made of synthetic material. The core unit is made of aluminum or aluminum alloy hereinafter designated aluminum containing metal which is preferably but not exclusively an aluminum alloy able to support a heat treatment as is the case for aluminum alloys of the A-G-S series, which is an Al-Mg,Si series.

To constitute the tube plates 2, stratified plates are used, for example three layer plates, comprising as shown in FIGS. 2 to 4 external sheets $2_1$, $2_2$ of basic aluminum containing metal between which is inserted, and fixed by plating, a sheet $2_3$ having a lower melting point than the sheets $2_1$, $2_2$. For example, the sheets $2_1$; $2_2$ are made of genuine aluminum having a melting temperature higher than 650° C, or of manganese-aluminum alloy having a melting temperature higher than 658° C, or of aluminum magnesium-silicon alloy having a melting temperature higher than 577° C.

The sheet $2_3$ is preferably constituted of an aluminum-silicon alloy which can contain between 7 and 13% in weight of silicon, thus the melting temperature of which is comprised within the range of 570° to 585° C. In some cases it is also possible to utilize a magnesium containing alloy, typically an aluminum-magnesium-silicon alloy having a composition which is close to the eutectic and the melting temperature of which is about 560° C.

An appropriate alloy may contain 13% in weight of silicon, 1.5% in weight of magnesium and 85.5% in weight of aluminum.

The stratified plate may comprise more than three layers, if desired, without departing from the scope of the invention.

For performing the brazing under good conditions by passing the assembled core, for example, in a brazing stove, various types of connection can be embodied. For example FIG. 2 shows that the tube plates 2 are cut to delimit tube passages 4 having a shape corresponding to that of the tubes, cutting being advantageously accomplished so as to prevent the edge of the cut to be smooth but, on the contrary, to delimit small scratches or roughnesses thereon.

In FIG. 2, the tubes 1 made of aluminum containing metal are neither covered with brazing alloy nor with any additional material. On the contrary in FIG. 3 the tubes 1*a* are plated on their outer surfaces with a coating 1*b* of the same composition as sheet $2_3$.

In FIG. 4, the non-covered tubes 1, as in FIG. 2, or, on the contrary the tubes covered as in FIG. 3 with a brazing alloy, are engaged into tube passages $4_1$ which are cut from the inclined edges of recesses 6 formed through stamping and advantageously are provided with fine scratches directed towards the tube passage $4_1$. Upon performing the brazing step, the sheet $2_3$ partly melts and the melting alloy wets the wall of the tube 1 to ensure the brazing. The modification of FIG. 4 with the recess 6 and the scratches 7 is more particularly advantageous when a flux is utilized for the brazing step. Actually, the scratches 7 of said recess act to drain the flux, when melted, towards the tube passage $4_1$.

According to FIG. 3, the coating 5 of the tube cooperates with the sheet $2_3$ to ensure the brazing and said coating 5 provides further to easily braze the intercalary parts 3 without the same having to be covered with a brazing alloy.

Another variant is shown in FIG. 5 wherein the stratified plates forming the tube plates 2 comprise only the sheets $2_1$ and $2_3$; the latter sheet being designed on the tube plate side which is opposite to the side turned towards the header box 5. The tube passages $4_2$ may be prepared according to one of the ways described in reference with FIGS. 2 to 4 or, on the contrary, be flanged by collars $4_3$.

Regarding the side plates 17, they are also, preferably, made of the same aluminum containing metal or basic alloy as that constituting the sheets $2_1$, $2_2$ of the tubes and intercalary parts or dissipators and said side plates advantageously have a shape which can compensate for the differential expansions which could exist between themselves and the tubes upon the brazing process. Said shape can, for example, be made as shown in the drawing by means of lugs 17*a* of a substantially U-shaped form which are distorted if there is expansion differences between the tubes 1 and the side plates during the brazing process.

The tube plates 2 are shaped on their periphery to delimit a hollow rim 8. In other words all the periphery of each tube plate is shaped to delimit first a flanged edge 9 then, from said flanged edge, a bottom 10 and, from said bottom 10, a raised edge 11.

FIGS. 6 and 7 show that the raised edge 11 is slotted at 12 at each tube plate angle to delimit only a small upwards shoulder 12*a*. The flanged edge 9 and the raised edge 11 which are parallel to each other or slightly divergent, provide a high flexion strength for the bottom 10 which is narrow.

The top or surface 10*a* of the bottom 10 is made up of the sheet $2_1$ which has not been submitted to any melting during the brazing of the core, said top is thereby perfectly smooth.

A gasket 13 is placed on said surface 10*a*, said gasket being made of soft deformable material for example of an elastomer. FIG. 8 shows that the gasket 13 advantageously has, on its inner edge small protruding fingers 14 which ensure its centering on the bottom 10 and provide that said gasket does not occupy the whole surface of said bottom.

If desired, other fingers 14 can also be designed from the outer edge of the gasket 13.

The gasket 13 is designed to ensure tightness between the surface 10*a* and a peripheral shoulder 15 which is formed by each header box 5. For a perfect tightness, the shoulder 15 of the header box is tightened on the gasket, for example by crimping the end 11*a* of the raised edge 11 onto the top of said shoulder 15. Thus the gasket 13 is distorted and, since it does not cover the whole surface of the top 10*a*, it has the possibility to slightly creep which highly improves the tightness realized by the same. For the same reason, it is advantageous that a small space 16 be provided between the wall of the header box and the opposite wall of the flanged edge 9. In fact said small space, in addition to providing for the creeping through deformation of the gasket 13, makes also possible slight deformations of the end plate without said deformations being transmitted to the bottom 10.

Said space 16 moreover constitutes a container for the muds and dirts directly formed into the radiator or in which they are brought during its utilization; said muds constitute then a protection for the gasket 13.

The structure of the core makes it particularly able to be brazed in a stove, said stove being either an air-stove, a neutral atmosphere stove or a vacuum stove, and whether or not brazing flux is utilized. In the case of FIGS. 2 to 4 the brazing alloy is well protected from the outside ambiant atmosphere by the basic metal covering it, which permits utilization only very small quantities of flux or even to avoid the utilization of any flux and, besides, the brazing alloy is brought directly into contact with the wall to be brazed without melting of the same increasing the thickness of the gasket under construction.

The invention is not restricted to the embodiments shown and described in detail, for various modifications thereof can moreover be applied to them without departing from the scope of the invention as shown in the appended claims.

I claim:

1. A method of the manufacture of radiators having a tube and fin core made of aluminum-containing metal, the core including tube plates and at least one header box connected to the tube plates by a soft gasket, comprising the steps of:

assembling fins to brazing alloy plated tubes;

providing tube plates made of laminated sheets of aluminum-containing metal and laminated with brazing alloy to form a laminate having a surface free of brazing alloy directed towards said header box;

shaping said laminate to delimit at the periphery of said laminate a hollow rim having a smooth inner bottom surface, said smooth inner bottom surface being free of brazing alloy;

assembling said tube plates on ends of said tubes, as an assembly, with said smooth inner bottom surface of said hollow rim directed outwardly of the radiator;

heating said assembly to brazing temperature, whereby said brazing alloy is melted thus brazing said tubes, fins and tube plates while smooth surface of each of said tube plates remains free from brazing alloy;

placing a soft deformable gasket on said smooth surface; and securing with pressure said header box on said gasket.

2. The method of claim 1 including covering said brazing alloy with a second sheet of aluminum-containing metal thereby sandwiching said brazing alloy between two sheets of aluminum-containing metal.

3. The method of claim 1 comprising the further step of cutting tube passages in said tube plates with at least one sheet of brazing alloy sandwiched between sheets of aluminum-containing metal thereby sandwiching said brazing alloy sheet between said sheets of aluminum-containing metal to engage said tubes inserted inside said tube passages upon the step of assembling said tube plates on said tubes

4. The method of claim 1 comprising further the step of boring tube passages through inclined edges in said tube plates.

5. The method of claim 1 comprising the further step of cutting in said tube plates tube passages provided with fine scratches.

6. The method of claim 1 comprising the further steps of cutting in said tube plates tube passaged open through inclined edges, and finely scratched said tube plates along said inclined edges toward said tube passage.

7. A method of claim 1 including the step of making said tubes of an aluminum-containing metal with a plating of brazing alloy covering the outer surface thereof.

8. The method of claim 1 wherein the step of shaping said sheets to delimit the hollow rim with a smooth bottom surface is made by forming a downwardly bent edge, a flat peripheral portion having said smooth bottom surface and an outer edge raising from said flat peripheral portion.

9. The method of claim 1 comprising the step of providing the soft deformable gasket with centering portions.

10. The method of claim 8 including the further step of providing said header box with a shoulder at the bottom thereof having a width less than the distance separating said downwardly bent edge from said outer edge to provide a fill space between said downwardly bent edge and said header box for creeping of the soft deformable gasket and compensating deformations of said tube plates.

11. The method of claim 1 wherein the step of securing with pressure the header box on said gasket is made through crimping means pressing said header box against said gasket and side plates rigidly connecting laterally said tube plates.

12. The method of claim 1 including the steps of providing said tube plates with distortable portions and of forming said hollow rim with a width larger than the width of said header box to compensate for deformations between said tubes and said tube plates.

13. The method of claim 1 comprising the further step of connecting side plates laterally to said tube plates.

14. The method of claim 1, including the step of forming each of said sheets from an aluminum-containing metal sheet having a smooth surface free of brazing alloy and an opposite surface thereof covered with a brazing alloy.

* * * * *